US005573500A

United States Patent [19]

Katsunuma et al.

[11] Patent Number: 5,573,500

[45] Date of Patent: Nov. 12, 1996

[54] SOLE MASSAGE DEVICE

[75] Inventors: Tatsuo Katsunuma; Tomio Fujikawa; Seiya Mabuchi, all of Kashiwa, Japan

[73] Assignee: Biopit Co., Ltd., Kashiwa, Japan

[21] Appl. No.: 310,578

[22] Filed: Sep. 22, 1994

[30] Foreign Application Priority Data

Mar. 24, 1994 [JP] Japan ..... 6-079428
Mar. 24, 1994 [JP] Japan ..... 6-079429

[51] Int. Cl.[6] ..... A61H 23/02

[52] U.S. Cl. ..... 601/111; 601/134; 601/103; 601/104

[58] Field of Search ..... 601/22, 61, 66, 601/67, 100, 101, 104, 107, 110, 111, 134, 103, 27–31

[56] References Cited

U.S. PATENT DOCUMENTS

| | | | |
|---|---|---|---|
| 1,838,094 | 12/1931 | Deyo | 601/27 |
| 2,186,105 | 5/1939 | Hall | 601/111 |
| 2,276,510 | 5/1942 | Newton | 601/22 |
| 2,604,091 | 3/1951 | Hansen | 601/27 |
| 2,836,174 | 5/1958 | Infanger | 601/27 |
| 3,640,272 | 2/1972 | Hussey | 601/116 |
| 3,830,232 | 8/1974 | McNair | 601/66 |
| 4,682,771 | 7/1987 | Jean | 272/73 |
| 4,936,292 | 6/1990 | Hidetugu | 601/104 |
| 5,167,225 | 12/1992 | Cheng | 601/104 |
| 5,305,737 | 4/1994 | Vago | 601/4 |

FOREIGN PATENT DOCUMENTS 531088 12/1940 United Kingdom .

*Primary Examiner*—Robert A. Hafer
*Assistant Examiner*—Brian E. Hanlon
*Attorney, Agent, or Firm*—Flynn, Thiel, Boutell & Tanis, P.C.

[57] ABSTRACT

A housing having an inclined surface and a pair of footrests is provided. A plurality of impact rods are disposed in perpendicular to the inclined surface and axially slidably mounted in the housing. An impact head is secured to a top of each of the impact rods. A reciprocating device is provided for reciprocating the impact rods so as to impact a sole of a user mounted on the footrest. A reciprocating device and a drive motor for actuating the reciprocating device are disposed in a mass block that is suspended from the housing.

25 Claims, 5 Drawing Sheets

SOLE MASSAGE DEVICE

BACKGROUND OF THE INVENTION

The present invention relates to a foot massaging device, and more particularly to a sole massaging device in which the foot sole of a user is massaged to promote circulation of blood in the sole and to stimulate the peripheral nerves of the sole.

As is well known, the artery, capillary and peripheral nerves are concentrated in the foot soles of the human body. If a leg is extremely tired, the circulation of the blood in the capillary becomes sluggish, causing the compression of the peripheral nerve. The recovery from this fatigue in the feet and legs is thus delayed. The peripheral nerve of the sole is connected with the brain through the nervous system. Therefore, it is said that the stimulation of the foot sole causes the brain to activate, and hence activation of the autonomic nerve can be expected.

In folk medicine, a semicircular shaped tool on which a foot is mounted is used to dissipate the fatigue in feet and legs. In the field of the oriental medicine, massage and acupuncture are used from times of old to stimulate an acupoint at which the peripheral nerve is concentrated.

Recently, there have been developed various types of massage devices for promoting the circulation of the blood, and low frequency current devices for stimulating the peripheral nerve.

In a massaging device, a plurality of pulsation rollers or pressure pads are provided that periodically press against the sole so as to promote circulation of the blood.

In the low frequency current device, electrodes are attached to acupoints at which the peripheral nerve is concentrated. A low frequency current is applied to the electrodes so as to relax muscles and tendons near the concentrated peripheral nerve.

However in a massaging device, the pressure of the roller or pad is sometimes too strong to provide a comfortable treatment and to recover from the fatigue. Furthermore, considerable electric power is expended driving heavy pulsation rollers or pressure pads. Therefore, a massaging device is not suitable for easy use.

In the low frequency current device, the circulation of the blood is promoted by relaxing and tensing the muscle. Such stimulation does not have much effect on expanding the capillary in the sole.

There have been proposed sole massaging devices having a plurality of impact massage heads for comfortably and rhythmically massaging a sole of a foot. These devices include a plurality of impact rods each having a massage head, and driving mechanism that include rod reciprocating systems and gear systems.

However, when the impact rods of these devices are actuated, the reciprocation system and the driving mechanism are subjected to significant vibrations. These vibrations are transmitted to a housing of the device, which causes noises and resonant sounds. Therefore such a massage device cannot be made into a high quality one.

SUMMARY OF THE INVENTION

A first object of the present invention is to provide a sole massaging device by which the sole of a foot is comfortably and rhythmically massaged without pain, thereby effectively expanding the capillaries and stimulating the peripheral nerves at the same time.

A second object of the present invention is to provide a sole massaging device which does not cause noises during the operation without extremely pressing the foot.

A third object of the present invention is to provide a sole massage device which has small power consumption requirements.

According to the present invention, there is provided a sole massaging device comprising a housing having an inclined surface and a pair of footrests, a plurality of impact rods disposed in perpendicular to the inclined surface that are axially slidably mounted in the housing. There is an impact head secured to the top of each of the impact rods and disposed so that a part of the impact head projects away from the footrest. There is a reciprocating device for reciprocating the impact rods so as to impact a sole of a user mounted on the footrest, and a driving device for driving the reciprocating device.

A mass block is suspended in the housing by horizontal springs and vertical springs so as to be held in a plane substantially parallel to the inclined surface, the impact rod, reciprocating device, and driving device are provided in the mass block.

The sole massaging device includes a power switch, a foot sensor for detecting mounting of a foot, a timer responsive to closing of the power switch for producing a signal for a predetermined time, an AND gate responsive to an output signal of the foot sensor and to the signal of the timer for producing a signal for operating a driving motor.

In another aspect of the present invention, the massage device has a gear box supported in the mass block with resilient means. The impact rod is slidably mounted in the gear box, the reciprocating device is mounted on the gear box, and the driving device is provided in the gear box.

The reciprocating device is arranged to cyclically project impact heads provided in one of the footrests.

These and other objects and features of the present invention will become more apparent from the following detailed description with reference to the accompanying drawings.

DETAILED DESCRIPTION OF THE PREFERRED EMBODIMENT

Figure 1:
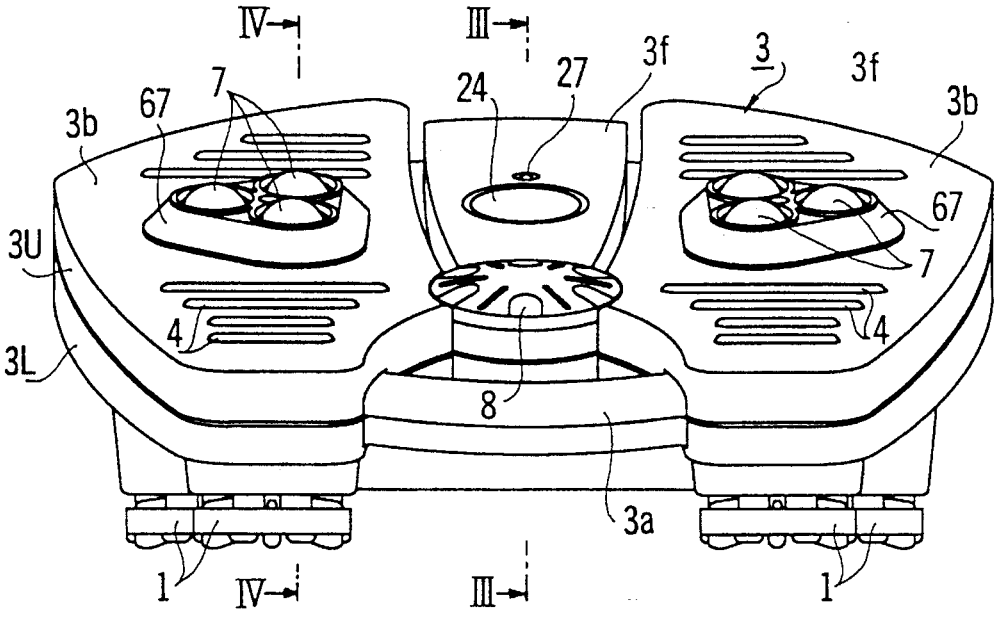
FIG. 1 is a front view showing a sole massage device of the present invention.
Figure 3:
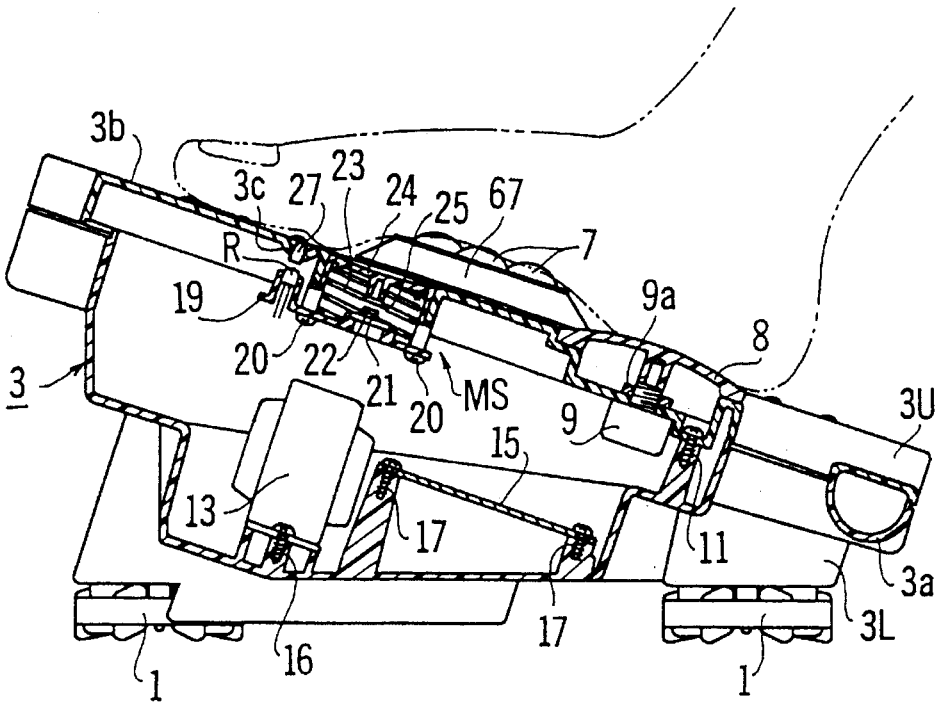
FIG. 3 is a sectional side view of the device taken along a line III—III of FIG. 1.

Referring to FIG. 1, a sole massage device of the present invention is put on a floor for use. The sole massage device comprises a hollow housing 3 having an upper housing 3U and a lower housing 3L, four cylindrical pedestals 1, each having a circular shape in plane and secured to the lower housing 3L, and a handle 3*a* for carrying the device. The lower housing 3L is secured to the upper housing 3U with screws 11 (FIG. 3). The pedestals 1 are provided for preventing the device from vibrating when in use.

The upper housing 3U has an inclined surface that forms right and left footrests 3*b* on which the right and left feet of the user sitting on a chair are positioned, and a central portion 3*f* between the footrests 3*b*. Anti-slip ribs 4 made of rubber are disposed on the footrests 3*b* so as to prevent the feet from slipping. Three massage impact heads 7 guided by a guide frame 67 are exposed from the footrests 3*b*. On the central portion 3*f*, a speed control dial 8, a power switch button 24, and a power indicator 27 are provided.

Figure 4:
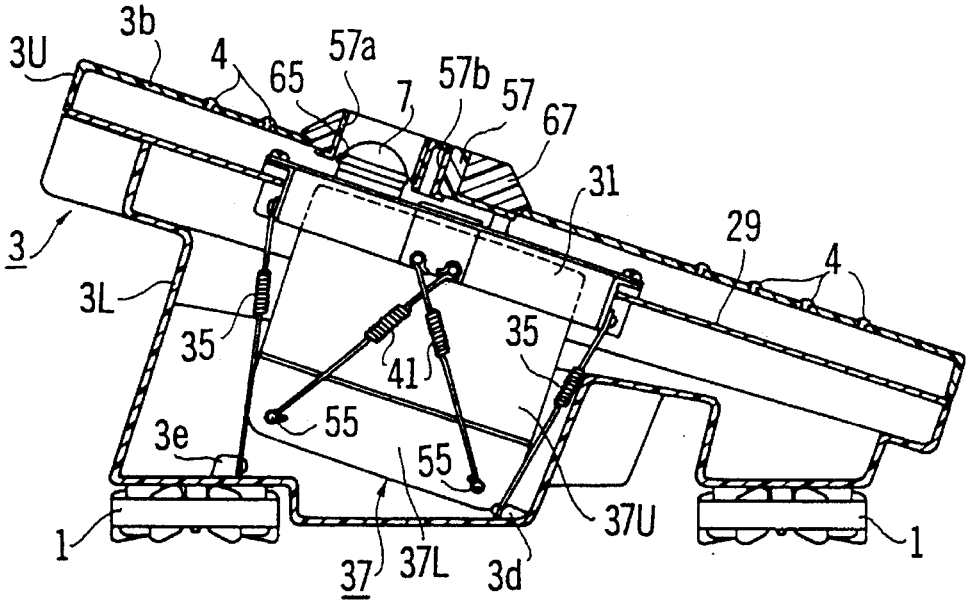
FIG. 4 is a sectional side view of the device taken along a line IV—IV of FIG. 1.
Figure 5:
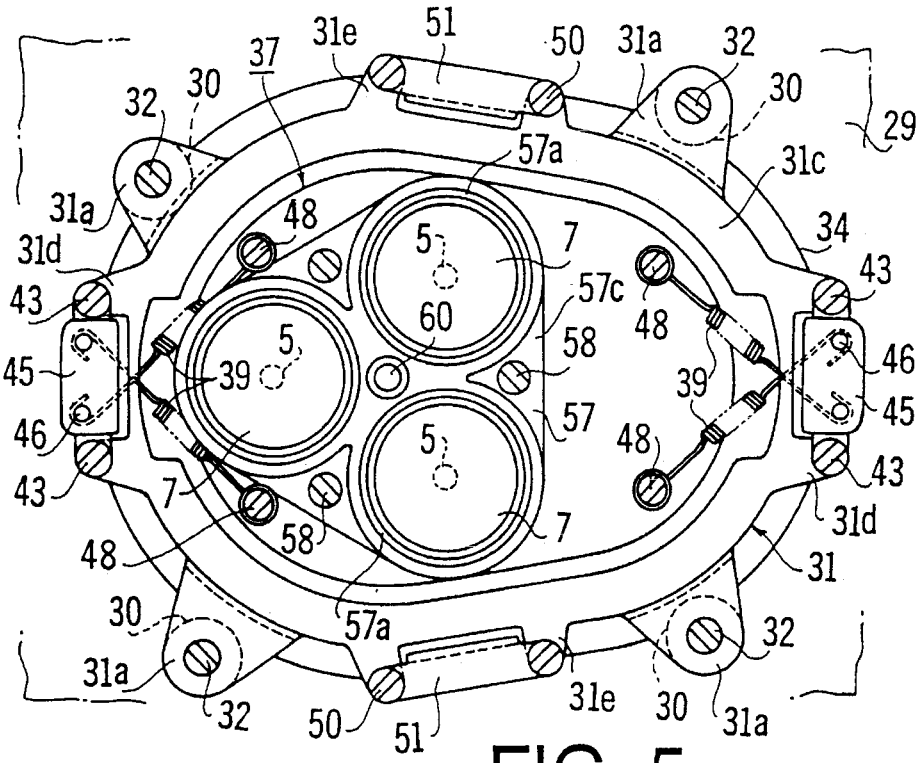
FIG. 5 is a plan view showing a main part of the device.
Figure 6:
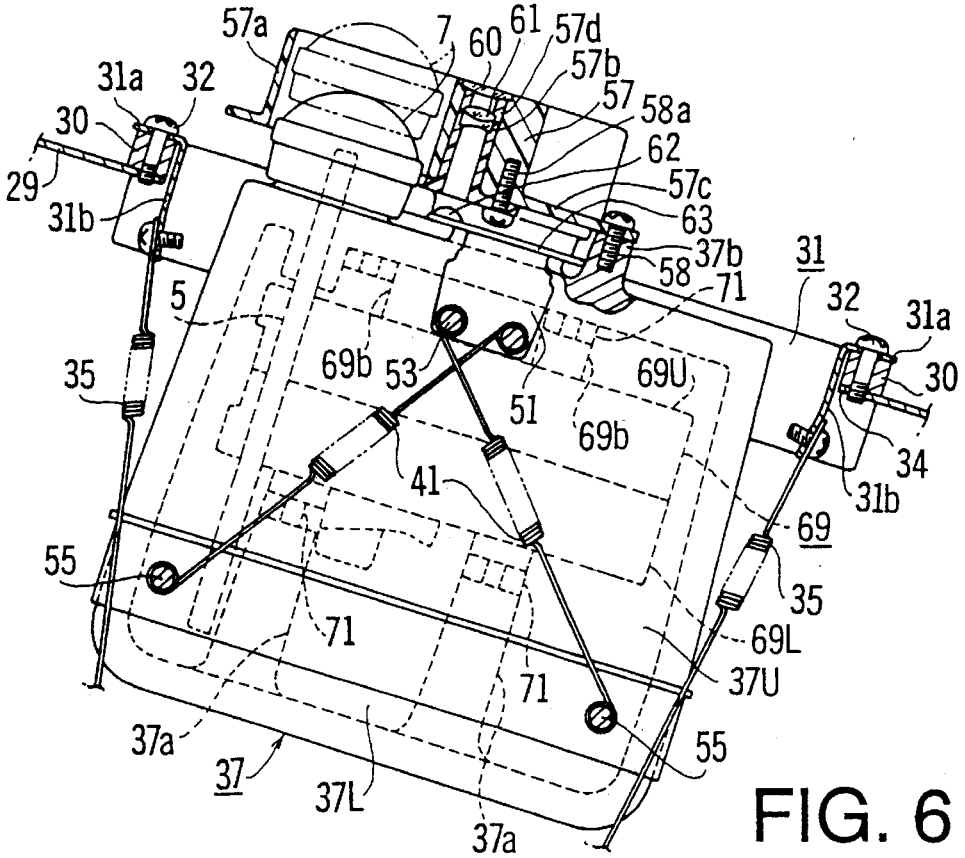
FIG. 6 is a sectional side view of the part shown in FIG. 5.

Referring to FIGS. 4, 5 and 6, a metallic frame plate 29 is secured between the upper housing 3U and the lower housing 3L corresponding to each footrest 3*b*. The frame plate 29 has an opening 34 with an elliptic shape, as shown in FIG. 5.

In the device of the invention, both of the right and left portions in the housing 3 have the same structure which is arranged in symmetry. Thus, only one of the portions will be described hereinafter.

An annular connecting frame 31 having an elliptic shape in plan view is secured to the periphery of the opening 34 of the frame plate 29. The connecting frame 31 has an annular base portion 31*b* and an upper flange 31*c*. Four connecting lugs 31*a* are formed on the upper flange 31*c*. A pair of lugs 31*d* are formed on the upper flange 31*c* at opposite sides on the major axis thereof, and a pair of lugs 31*e* are formed on the upper flange 31*c* at opposite sides on the minor axis thereof.

Each of the connecting lugs 31*a* is mounted on the periphery of the opening 34 through a damping member 30 made of rubber and secured thereto with a screw 32.

A pair of springs 35 are provided between the base portion 31*b* and hook portions 3*d* and 3*e* provided on the bottom of the lower housing 3L opposite to each other. Thus, the connecting frame 31 is urged toward the lower portion of the housing 3. Consequently, even if the screw 32 is accidentally disengaged from the frame plate 29, the connecting frame 31 is prevented from separating from the plate 29.

A hollow heavy mass block 37 having a driving mechanism is mounted in the housing 3 by the connecting frame 31. The mass block 37 is made of aluminum molded by die casting, and comprises an upper block 37U and a lower block 37L. The upper block 37U and the lower block 37L are coupled through a shielding means, thereby preventing noises produced in the mass block from leaking.

As shown in FIG. 5, a bracket 45 is secured to each of the lugs 31*d* with screws 43. A pair of horizontal springs 39 are provided between pins 46 on the bracket 45 and screws 48 secured to an upper plate of the upper block 37U, arranged in cross. The mass block 37 is thus suspended by the horizontal springs 39 in the lower housing 3L such that an upper surface of the mass block 37 is parallel with the inclined footrests 3*b* of the housing 3.

As shown in FIG. 6, a bracket 51 is secured to the lugs 31*e* on each side with screws 50. A pair of vertical springs 41 are provided between screws 53 secured to the bracket 51 and screws 55 secured to a side plate of the lower block 37L, arranged in cross. The mass block 37 is thus vertically suspended in the lower housing 3L by the vertical springs 41.

Consequently, the mass block 37 is stably suspended in the housing 3 by the horizontal and vertical springs 39 and 41, respectively, so as to be held in balance.

Figure 7:
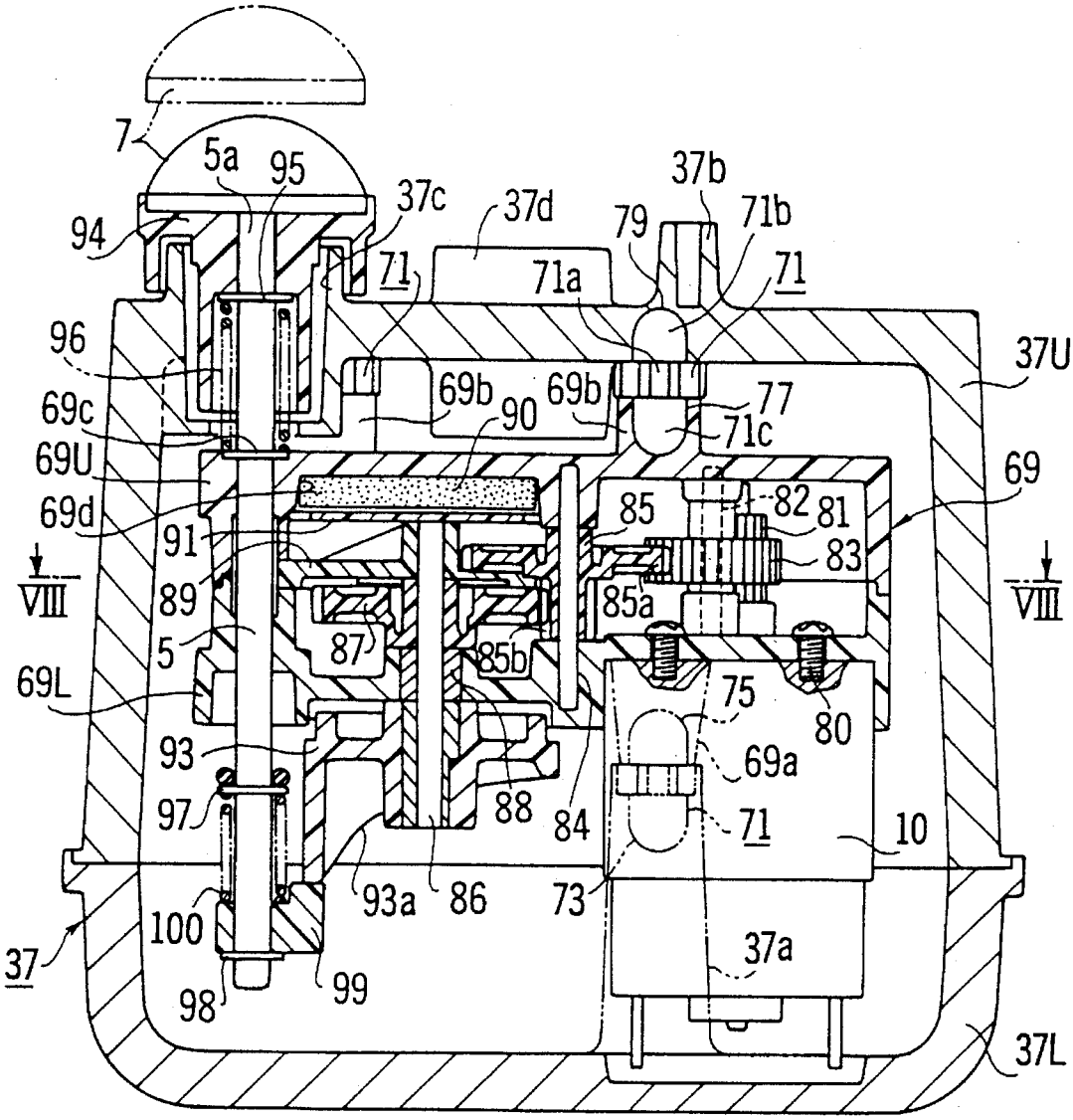
FIG. 7 is a sectional view showing a driving system in a mass block of the device.

Referring to FIG. 7, the upper block 37U of the mass block 37 has three posts 37*b* (only one of them is viewed), three openings 37*c* (only one of them is viewed) and a base 37*d* formed on the upper plate thereof.

In the mass block 37, a gear box 69 having a rod reciprocating device and a driving device for the reciprocating device are mounted. The gear box 69 is made of plastic such as polyacetal resin and formed by injection molding and comprises an upper box 69U and a lower box 69L. The rod reciprocating system includes a reduction gear system.

As shown in FIG. 7, the gear box 69 is mounted in the mass block 37 by a plurality of resilient damping members 71. Each damping member 71 comprises a collar 71*a*, and upper and lower resilient dampers 71*b* and 71*c*, respectively, integral with the collar at opposite sides thereof.

Figure 9:
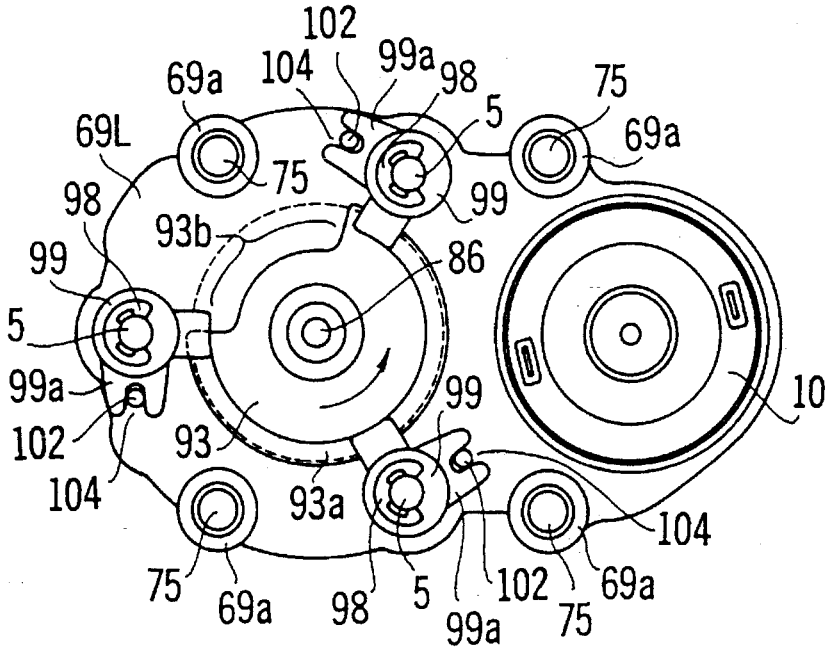
FIG. 9 is a plan view of the gear box as viewed from the underside thereof.

The lower block 37L has four posts 37*a* each of which has a hole 73. The lower box 69L has four posts 69*a* formed corresponding to the posts 37*a*, each having a hole 75 (FIG. 9). The lower damper 71*c* of the damping member 71 is engaged in the hole 73 and the upper damper 71*b* is fitted in hole 75.

The upper box 69U has four posts 69*b* each of which has a hole 77. The upper block 37U has four holes 79 formed on an inner wall of an upper plate thereof corresponding to the posts 69*b*. The lower damper 71*c* of the damping member 71 is engaged with the hole 77 and the upper damper 71*b* is engaged in the hole 79.

Thus, vibration of the gear box 69 is damped by the resilient damping members 71 and not transmitted to the mass block 37.

Three impact rods 5 (only one of them is viewed in FIG. 7) each of which has the massage impact head 7 are axially slidably mounted in the gear box 69. A cylindrical retainer 94 made of resin is engaged on each of the rods 5 adjacent the head 7 and upwardly projected from the upper block 37U passing through a hole 37C formed in the upper plate of the block 37U. The rods 5 are parallel with each other along their longitudinal axes and are disposed so as to be perpendicular to the inclined footrest 3*b* of the housing 3. In a retracted position, the massage impact head 7 is located near the upper block 37U.

Figure 8:
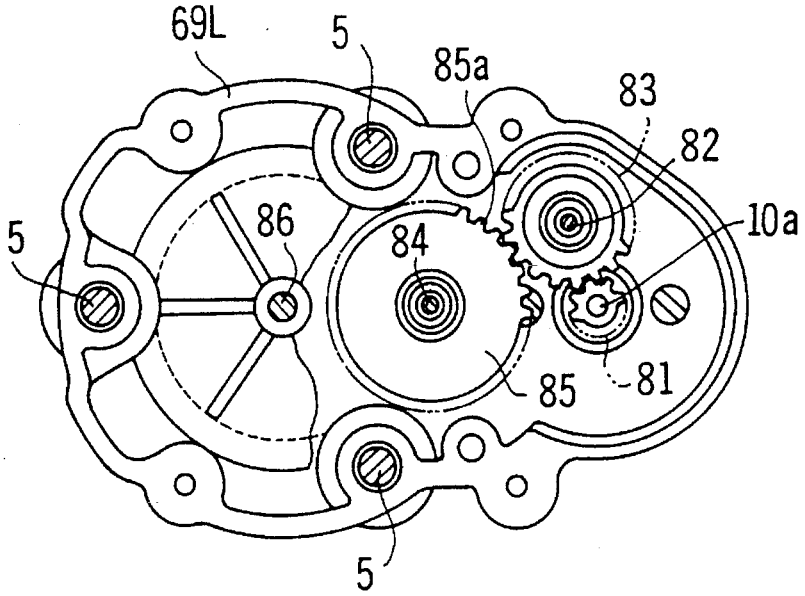
FIG. 8 is a sectional view showing a gear box taken along a line VIII—VIII of FIG. 7.

Describing the reciprocating device and driving device for the impact rod 5, a direct current motor 10 is secured to the underside of the lower box 69L with screws 80. A drive pinion 81 secured to a drive shaft 10*a* (FIG. 8) of the motor 10 is engaged with an intermediate gear 83 which is rotatably mounted on an intermediate shaft 82 secured to the upper and lower boxes 69U and 69L. The intermediate gear 83 is engaged with a large diameter gear 85*a* of a first reduction gear 85 which is rotatably mounted on a first shaft 84 secured to the upper and lower boxes. A pinion 85*b* of the first reduction gear 85 is engaged with a second reduction gear 87 which is secured to a second shaft 86 rotatably supported on the lower box 69L through a bearing 88. An upper portion of the second shaft 86 is rotatably supported by a supporting disc 89 disposed between the upper and lower boxes 69U and 69L. Secured to a lower end portion of the second shaft 86 is a cylindrical cam 93.

Each impact rod 5 is slidably engaged in the retainer 94, and the impact head 7 is secured to the upper end 5*a* of the rod 5. A coil spring 96 is provided between a collar 95 secured to the rod 5 and a shoulder 69*c* of the upper box 69U so as to urge the rod 5 upwardly. On a lower end portion of the impact rod 5 slidably mounted is a cam follower 99. A buffer spring 100 is provided between a retainer 97 secured to the rod 5 and a shoulder of the cam follower 99, so that the cam follower 99 is yieldably engaged with an E-ring 98. Thus the cam follower 99 is resiliently engaged with the cam surface of the cylindrical cam 93 by the spring 96.

As shown in FIG. 9, the cylindrical cam 93 comprises a cam lobe portion 93*a* in the range of 240 degrees and a recessed cam portion 93*b* in 120 degrees. The three cam followers 99 slidably mounted on the respective impact rods 5 are yieldably engaged with cam surface of the cam 93 at equi-angular disposition at 120 degrees. A guide pin 102 projected on the lower box 69L is engaged with a recess 104 of a fork 99*a* of each cam follower 99, thereby preventing the cam follower 99 from rotating about the rod 5.

In place of the cylindrical cam, a driving system having another cam can be used.

A plastic disc 91 and a lubricating oil pad 90 are disposed in a recess 69*d* formed in the inner wall of the upper box 69U. The upper end of the second shaft 86 is slidably engaged with the disc 91.

Thus, when the reduction gear device and the cam mechanism are rotated by the motor, lubricating oil in the pad 90 is gradually fed to the parts for the lubricating thereof, thereby preventing the generation of noises.

As shown in FIGS. 5 and 6, a supporting member 57 having a triangle shape in plan view is secured to the posts 37*b* of the upper block 37U by screws 58. The supporting member 57 has a base plate 57*c*, three cylindrical guides 57*a* integrally formed on the base plate, and a central hole 57*d* formed in the central portion adjacent to the cylindrical guides 57*a*.

Each of the guide portions 57*a* surrounds the impact head 7 for guiding the head in the axial direction.

In the central hole 57*d*, a lens-barrel 57*b* is inserted and secured to the supporting member 57 with a screw 58*a*. A condenser lens 61 is mounted in the lens-barrel 57*b*, protected by a protection glass 60 mounted on outer periphery of the hole 57*d*. At a lower portion of the supporting member 57, a terminal board 63 is mounted on the base 37*d* of the upper block 37U. A CCD element 62 as a foot sensor is mounted on the terminal board 63 corresponding to the lens-barrel 57*b* at a focused position of the lens 61.

As shown in FIG. 4, a guide frame 67 is secured to the footrest 3*b* of the upper housing 3U and abutted on the base plate 57*c*of the supporting member 57.

The cylindrical guide 57*a* of the supporting member 57 is guided by an inner periphery 65 of the guide frame 67 to be perpendicular to the footrest 3*b*. Thus, the position of the mass block 37 is ensured in the axial and horizontal directions.

When a foot is positioned on the footrest 3*b*, the foot sensor 62 detects that the light is blocked by the foot and the motor 10 is turned on, as will be described hereinafter.

Referring to FIG. 3, a transformer 13 is provided in the lower housing 3L for dropping a voltage of a commercial alternating source. The transformer 13 is secured to the bottom with a screw 16. The dropped voltage is rectified by a rectifier which is mounted on a main printed circuit board 15. The circuit board 15 having elements such as the rectifier is secured to posts formed on the bottom with screws 17.

A sub-circuit board 19 is secured to an inner portion of the upper housing 3U with screws 20, corresponding to the power button 24 provided on the central portion 3*f* of the upper housing 3U. A switch 21 of a power switch MS is mounted on the sub-circuit board 19. The switch 21 has a fixed contact 22 which is provided corresponding to a movable contact 25 connected to the power button 24. A return spring 23 is provided between the movable contact 25 and the sub-circuit board 19 so as to urge the movable contact 25 in an open state.

The sub-circuit board 19 is further provided with a power lamp R comprising a light emitting diode (LED) element. The power lamp R is provided corresponding to the power indicator 27 comprising a light transmittable member engaged in a hole 3*c* of the upper housing 3U.

The speed control dial 8 is connected to a shaft of a speed adjuster 9 secured to the upper housing 3U with a nut 9*a*. The reciprocating speed of the impact rod 5 is controlled by rotating the dial 8 with fingers of the foot.

Figure 2:
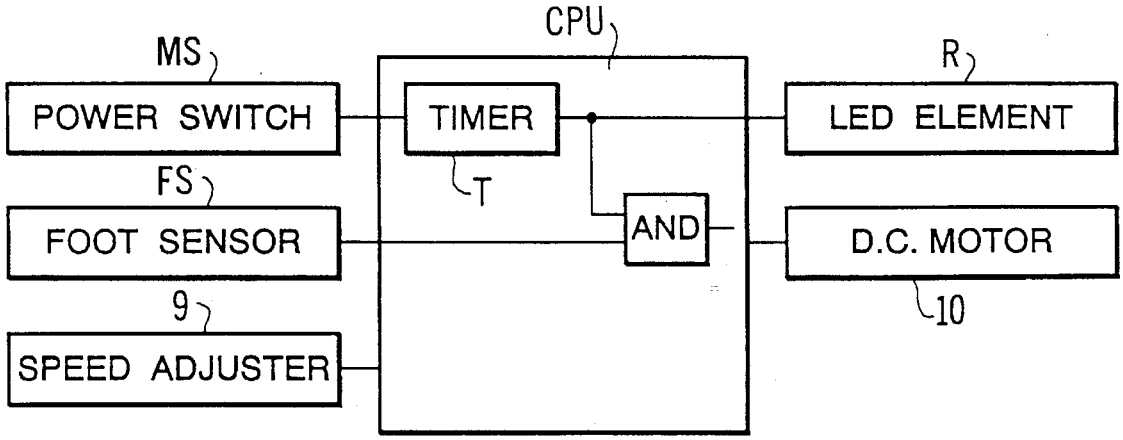
FIG. 2 is a block diagram showing a control circuit of the sole massage device.

Referring to FIG. 2, output signals of the power switch MS, foot sensor 62 and speed adjuster 9 are applied to a CPU. The CPU includes a timer T and an AND gate. The timer T is set to produce a signal for a predetermined time, for example, 10 minutes.

When the power button 24 is pushed, the movable contact 25 engages with the fixed contact 22. Thus, the power switch MS is turned on, producing a signal which is applied to the timer T to reset the timer. The timer T produces the signal for the predetermined time (10 minutes), so that the LED element of the power lamp R is turned on. The signal of the timer T is further applied to an input of the AND gate. The other input of the AND gate is supplied with a signal from the foot sensor 62. Thus an output signal from the AND gate is applied to the motor 10 as a driver_on signal. An output of the speed adjuster 9 is applied to the motor 10. Thus, the motor 10 is operated at a speed dependent on the output signal of the speed adjuster.

When the power lamp R is turned on, the on-state is displayed by the indicator 27.

The operation of the device will be described hereinafter. The power button 24 is pushed to turn on the power switch MS. The timer T is reset for 10 minutes. The power indicator 27 emits the light to indicate a waiting state of the operation of the massage device to the user. The user sits down on a chair and positions his feet on the footrest 3*b* such that the arch of each sole is abutted on a set of impact heads 7. The foot sensor 62 detects the existence of the foot so that the motor 10 starts to operate. The motor 10 rotates the second shaft 86 through intermediate gear 83, first reduction gear 85, and second reduction gear 87. Thus, the cylindrical cam 93 is rotated in the direction shown by an arrow of FIG. 9. When the cam follower 99 of one of the impact rods 5 is mounted on the cam lobe portion 93*a*, the impact rod 5 is axially moved in the lower direction as shown in FIG. 7. The spring 96 is compressed and the impact head 7 and the retainer 94 are retracted. When the cam 93 is further rotated and the cam follower 99 falls on the recessed cam surface 93*b*, the impact rod 5 is rapidly moved in the upward direction by elastic force of the spring 96, whereby the sole of the foot is impacted by the massage impact head 7. Thus, three impact heads 7 cyclically hit the sole.

When the foot is removed from the footrest 3*b* during the operation, the foot sensor 62 detects the removable to stop the generation of the signal. Consequently, the motor 10 stops. Even if the foot is not removed from the footrest, if the set time of the timer T has passed, the motor also stops. Thus, the power waste is prevented.

The impact period of the impact heads 7 is controlled by the speed control dial 8.

In accordance with the present invention, each of the massage impact heads repeatedly impacts the sole of the foot with a light force. Thus, peripheral nerve in the sole is stimulated and capillary is expanded, thereby promoting the circulation of the blood. Consequently, the foot is effectively massaged.

If the foot has a damage such as tenosynovitis, the diseased part is loosened up by the massage impact heads with light force.

Furthermore, the mass block is suspended from the housing by springs and the gear box having the driving mechanism is suspended from the mass block by resilient damping members. Thus, noises and vibration of the gear box are not transmitted to the mass block, and vibration of the mass block is damped. Thus, the vibration of the housing and generation of noise are prevented. Consequently, a foot massage device having a high quality can be provided.

While the invention has been described in conjunction with preferred specific embodiment thereof, it will be understood that this description is intended to illustrate and not limit the scope of the invention, which is defined by the following claims.

What is claimed is:

1. A foot sole massaging device including:

a housing formed of rigid material having an upper section, said housing upper section defining an inclined surface that extends along a selected plane, said inclined surface defining at least one foot rest surface;

a mass block disposed in said housing and suspended from said housing upper section by a member that is substantially more flexible than said housing rigid material, said mass block having a top surface and said mass block being suspended from said housing so that said mass block top surface is normally in a plane substantially parallel with said plane in which said housing inclined surface lies;

a plurality of impact rods disposed in said mass block and slidably mounted in said mass block to selectively extend above said housing upper section inclined surface adjacent said at least one footrest surface;

a plurality of impact heads, each said impact head being attached to a top end of a separate one of said impact rods so as to be located above and adjacent said at least one footrest surface;

a reciprocating assembly disposed in said mass block and connected to said impact rods for selectively moving said impact rods in a reciprocating motion; and a drive unit disposed in said mass block and connected to said reciprocating assembly for selectively actuating said reciprocating assembly so as to cause said reciprocating motion of said impact rods.

2. The foot sole massaging device of claim 1, wherein: said housing inclined surface defines two spaced apart footrest surfaces; and said sole massaging device includes a multiplicity of said impact rods and said impact heads wherein said impact rods and said impact heads are arranged so that at least two impact heads are located adjacent to and above each said footrest surface.

3. The foot sole massaging device of claim 2, wherein: said device includes a second mass block; separate said flexible members extending from said housing to each said mass block for independently flexibly suspending each said mass block from said housing and each said mass block includes a separate set of impact rods and said impact heads, a separate one of said reciprocating assemblies and a separate one of said drive units.

4. The foot sole massaging device of claim 3, wherein said flexible members that flexibility suspended said mass blocks from said housing are springs.

5. The foot sole massaging device of claim 3, wherein said reciprocating assembly includes a rotating cam formed with a camming surface; a cam follower slidably mounted to each of said impact rods, said cam followers being positioned to abut said camming surface; a stop ring secured to each said impact rod restricting movement of said cam follower along one axial direction of said impact rod; a plurality of biasing springs, each said biasing spring connected to a separate one of said impact rods for urging said associated cam follower against said camming surface; and a plurality of buffer springs, each said buffer spring being positioned to urge a separate one of said cam followers against said associated stop ring, wherein said camming surface is shaped so that when said cam is actuated, said impact rods are reciprocally displaced in a predetermined sequential pattern.

6. The foot sole massaging device of claim 3, wherein a plurality of said flexible members extend between said housing and each said mass block for flexibly suspending each said mass block from said housing.

7. The foot sole massaging device of claim 1, wherein said flexible member is a spring.

8. The foot sole massaging device of claim 1, wherein at least one said impact rod extends perpendicularly upward relative to said at least one footrest surface.

9. The foot sole massaging device of claim 1, wherein said reciprocating assembly includes a cam unit for inducing reciprocating movement in said impact rods.

10. The foot sole massaging device of claim 9, wherein said cam unit includes: a rotating cam formed with a camming surface; a cam follower slidably mounted to each of said impact rods, said cam followers being positioned to abut said camming surface; a stop ring secured to each said impact rod restricting movement of said cam follower along one axial direction of said impact rod; a plurality of biasing springs, each said biasing spring connected to a separate one of said impact rods for urging said associated cam follower against said camming surface; and a plurality of buffer springs, each said buffer spring being positioned to urge a separate one of said cam followers against said associated stop ring, wherein said camming surface is shaped so that when said cam is actuated, said impact rods are reciprocally displaced in a predetermined sequential pattern.

11. The foot sole massaging device of claim 1, further including:

a power switch for controlling the application of an electric current to said drive unit;

a foot sensor mounted on said mass block for detecting the placement of the foot on said at least one footrest surface;

a timer connected to said power switch configured to produce a timing signal for a selected time period upon the closing of said power switch; and an AND gate connected to receive as inputs said timer signal and a signal from said foot sensor, said AND gate asserting an output signal that is applied to said drive unit, and wherein said drive unit is connected to receive said output signal from said AND gate and to actuate said reciprocating assembly in response to receipt of said AND gate output signal.

12. The foot sole massaging device of claim 1, wherein said reciprocating assembly is disposed in a gear box contained in said mass block and at least a section of each said impact rod is partially disposed in said gear box and, said gear box is suspended in said mass block by at least two spaced apart resilient dampening members.

13. The foot sole massaging device of claim 12, further including a gear reduction unit connected between said drive unit and said reciprocating assembly transferring power from said drive unit to said reciprocating assembly, wherein, said gear reduction unit is disposed in said suspended gear box.

14. The foot sole massaging device of claim 1, further including:

a gear box contained in said mass block, said gear box is suspended in said mass block by at least two spaced apart resilient dampening members, wherein said reciprocating assembly is contained in said gear box and at least a portion of each said impact rod is disposed in said gear box; and a gear reduction unit connected between said drive unit and said reciprocating unit transferring power from said drive unit to said reciprocating unit, wherein, said gear reduction unit is disposed in said gear box.

15. The foot sole massaging device of claim 1, wherein a plurality of said flexible members extend between said housing and said mass block for flexibly suspending said mass block from said housing.

16. The foot sole massaging device of claim 15, wherein said flexible members are springs.

17. A foot sole massaging device including:

a housing having an upper section, said housing upper section defining an inclined surface that extends along a selected plane, said inclined surface defining at least one footrest surface;

a mass block disposed in said housing, said mass block being suspended in said housing by a flexible member that allows said mass block to move relative to said housing;

a plurality of impact rods disposed in said mass block and slidably mounted in said mass block to selectively extend above said housing upper section incline surface adjacent said at least one footrest surface;

a plurality of impact heads, each said impact head being attached to a top end of a separate one of said impact rods so as to be located above and adjacent said at least one footrest surface;

a reciprocating assembly disposed in said mass block and connected to said impact rods for selectively moving said impact rods in a reciprocating motion;

a drive unit disposed in said mass block and connected to said reciprocating assembly for selectively actuating said reciprocating assembly so as to cause said reciprocating motion of said impact rods, said drive unit being configured to actuate said reciprocating assembly at a variable speed in response to the application of a speed control signal thereto; and a speed controller for applying said speed control signal to said drive unit, said speed controller being disposed in said housing and having a manually adjustable dial for establishing said speed control signal, said dial being mounted to said housing so as to extend outwardly from said housing inclined surface.

18. The foot sole massaging device of claim 17, further including:

a power switch for controlling the application of an electric current to said drive unit;

a foot sensor mounted on said mass block for detecting placement of the foot on said at least one footrest surface;

a timer connected to said power switch configured to produce a timing signal for a selected time period upon the closing of said power switch; and an AND gate connected to receive as inputs said timer signal and a signal from said foot sensor, said AND gate asserting an output signal that is applied to said drive unit, and wherein said drive unit is connected to receive said output signal from said AND gate and to actuate said reciprocating assembly in response to receipt of said AND gate output signal.

19. The foot sole massaging device of claim 17, wherein: said housing inclined surface defines two spaced apart footrest sections; said sole massaging device includes a multiplicity of said impact rods and said impact heads so that said impact rods and said impact heads are arranged so that at least two impact heads are located adjacent to and above each said footrest surface; and said speed controller dial is located between said footrest surfaces.

20. The foot sole massaging device of claim 19, wherein said speed control dial lies in a plane approximately parallel to said plane in which said housing inclined surface lies.

21. A foot sole massaging device including:

a housing having an upper section, said housing upper section defining an inclined surface that extends along a selected plane, said inclined surface defining at least one foot rest surface;

a mass block disposed in said housing by an elastic means for flexibly suspending said mass block from said housing upper section;

a gear box disposed in said mass block by at least one resilient vibration damping member;

a plurality of impact rods slidably mounted in said gear box and extending axially upward toward said at least one footrest surface;

a plurality of impact heads, each said impact head being attached to a top end of a separate one of said impact rods so as to be located above and adjacent said at least one footrest surface;

a cam assembly disposed in said gear box, said cam assembly including: a rotating cam formed with a camming surface; a cam follower slidably mounted to each of said impact rods, said cam followers being positioned to abut said camming surface; a stop ring secured to each said impact rod restricting movement of said cam follower along one axial direction of said impact rod; a plurality of biasing springs, each said biasing spring connected to a separate one of said impact rods for urging said associated cam follower against said camming surface; and a plurality of buffer springs, each said buffer spring being positioned to urge a separate one of said cam followers against said associated stop ring, wherein said camming surface is shaped so that when said cam is actuated, said impact rods are reciprocally displaced in a predetermined pattern;

an electric motor disposed in said mass block and a gear reduction unit connected to said motor and disposed in said gear box and connected to said cam assembly for actuating said cam;

a speed adjuster for providing a speed control signal to said electric motor, said speed adjuster having a dial for manually establishing said speed control signal, said dial projecting from said housing inclined surface; and a control circuit for regulating the application of drive current to said motor, said control circuit including: a power switch for controlling the application of power to said motor; a timer connected to said power switch for generating a signal for a predetermined time period upon the closing of said power switch; an optical sensor mounted to said mass block for sensing the placement of a foot on said foot rest surface and for producing a foot placed signal when a foot is so positioned; a logic gate connected to receive said timer signal and said foot placed signal that in response to receipt of said signals, asserts a driver_on signal, wherein said electric motor is connected to receive said driver_on signal and is activated in response to receiving said driver_on signal.

22. The foot sole massaging device of claim 21, wherein said elastic means is a spring.

23. The foot sole massaging device of claim 21, wherein:

said housing inclined surface defines two spaced apart foot rest surfaces;

a second block mass is disposed in said housing and separate said elastic means extend from said housing to an associated one of said mass blocks each said elastic means being configured to suspend said associated mass block from said housing upper section so as to isolate movement of said associated mass block from said housing and to suspend said associated mass block below a separate one of said foot rest surfaces and each said mass block includes a separate said gear box secured therein by at least one said resilient vibration damping member wherein each said gear box includes a separate set of a plurality of said impact rods and said impact heads, each said set of impact heads being located over and adjacent to a separate one of said foot rest surfaces and a separate said cam assembly and a separate said motor for actuating said impact rods.

24. The foot sole massaging device of claim 23, wherein each said elastic means comprises a plurality of springs that extend from said housing to each said mass block.

25. The foot sole massaging device of claim 21, wherein said elastic means comprises at least one spring that extends from said housing to said mass block.

* * * * *